United States Patent [19]

Suzuki et al.

[11] Patent Number: 4,805,275

[45] Date of Patent: Feb. 21, 1989

[54] METHOD OF PRODUCING NONWOVEN FABRICS

[75] Inventors: Migaku Suzuki; Toshio Kobayashi, both of Kawanoe, Japan

[73] Assignee: Uni-Charm Corporation, Ehime, Japan

[21] Appl. No.: 538,471

[22] Filed: Oct. 3, 1983

Related U.S. Application Data

[63] Continuation of Ser. No. 293,512, Aug. 17, 1981, abandoned.

[30] Foreign Application Priority Data

Aug. 20, 1980 [JP] Japan ..... 55-114151

[51] Int. Cl.[4] ..... D04H 1/46

[52] U.S. Cl. ..... 28/104

[58] Field of Search ..... 28/104, 105

[56] References Cited

U.S. PATENT DOCUMENTS

| | | | |
|---|---|---|---|
| 3,281,902 | 11/1966 | Kalwaites | 19/106 X |
| 3,449,809 | 6/1969 | Shin | 28/105 X |
| 3,485,706 | 12/1969 | Evans | 28/105 X |
| 4,172,172 | 10/1979 | Suzuki et al. | 28/104 X |
| 4,190,695 | 2/1980 | Niederhauser | 28/104 X |

*Primary Examiner*—Robert R. Mackey

*Attorney, Agent, or Firm*—Fred Philpitt

[57] ABSTRACT

Methods are disclosed for treating fibrous webs with water jet streams. A water impermeable member is employed as a member for supporting the fibrous web in the water jet steam treatment. The jet treatment is carried out on a plurality of water impermeable rolls multistagedly and parallely arranged in order to provide effective draining treatment and effective entangling treatment of fibers after having been carried out on a water impermeable belt in order to transfer toward said rolls. The nonwoven fabrics obtained through the method do not substantially comprise openings and the fibers are intricately and firmly entangled in three dimensional direction.

12 Claims, 5 Drawing Sheets

METHOD OF PRODUCING NONWOVEN FABRICS

This is a continuation of application Ser. No. 293,512, filed Aug. 17, 1982, now abandoned and the benefits of 35 USC 120 and claimed relative to its.

BACKGROUND OF THE INVENTION

This invention relates to a method of producing nonwoven fabrics not substantially comprising openings through a treatment with high velocity water streams. More particularly, the invention relates to an improvement in a method of producing nonwoven fabrics wherein a fibrous web (or a batt: this interchangeability of term applies to all of the same term, fiber web, appearing in the following statements) is treated on a water impermeable supporting member with water jet streams ejected from a nozzle.

In a conventional method of producing nonwoven fabrics of the type wherein configuration of nonwoven fabrics is maintained by an individual fiber entanglement carried out through a treatment with water jet streams, two methods are available with reference to selection of a member for supporting the fibrous web in the water jet streams treatment: one being a method wherein a water permeable supporting member consisting of a porous screen or of a porous plate is employed; the other being a method wherein a water impermeable supporting member consisting of a roll or of a plate is employed.

Under the method of employing the water permeable supporting member, since the water jet streams ejected onto the fibrous web pass through the supporting member, draining treatment of the water streams can be easily made and the fibrous web may be treated with good stability.

However, the water streams still are of a considerable pressure even after passing through the fibrous web and the supporting member, no effective utilization of energy of the water streams in the entangling treatment is provided. Such tendency increases particularly in proportion to the decrease in the weight of the fibrous web per square meter and affects the efficiency. Accordingly, under the method of employing the water permeable supporting member, neither improvement in the production speed nor reduction in the production costs can be attained. Furthermore, since this method necessitates the treatment with extremely high pressure of water jet streams, large scale production facilities are involved and is therefore not economical.

Under the method of employing the water impermeable supporting member, water jet streams ejected onto the fibrous web pass through the fibrous web, collide with the surface of the supporting member and are converted into rebound streams to act again, provided that the question of the draining treatment is effectively resolved, wherefore the fiber entanglement can effectively be carried out by an interaction between the jet streams and the rebound streams. Accordingly, this method does not accompany the disadvantages as seen in the method of employing the water permeable supporting member discussed above. It is to be noted, however, that since the water streams do not permeate through the supporting member under the method of employing the water impermeable supporting member a question as to how the draining treatment should be made remains; in the case where the draining is not carried out sufficiently, fibers float in the water and said fibers are acted upon by the jet streams whereby the energy of the jet streams is sharply diminished, entangling treatment of the fibers is hindered, the fibrous web is caused to be disarranged and the stability in the treatment thereof is lost. For these reasons, the method discussed does not make it possible to provide nonwoven fabrics with superior property. In this connection, employment of a roll, a curved plate, a grooved plate or the like as a water impermeable supporting member have heretofore been proposed but a mere selection of such member does not ably overcome the problems. None of the conventional literature regarding the method of employing the water impermeable supporting member discloses concrete measures to effectively solve the various problems discussed above. In fact, the method of employing the water impermeable supporting member has not yet been successfully put into industrial practice, so far as the inventors of the present invention know.

Accordingly, the basic object of the present invention resides in the provision of a method of producing whereby various problems discussed above can effectively be overcome and a nonwoven fibrous sheet with superior property can industrially be produced in large quantity. Other objects will be understood from the following statements.

In order to attain the above object, the present invention provides a method of producing nonwoven fabrics wherein: in a method of producing nonwoven fabrics wherein a fibrous web is guided onto a water impermeable supporting member and said fibrous web is subjected to water jet streams ejected from the nozzles which are arranged with intervals in a manner to face the surface of said fibrous web and to run across the width thereof whereby entangling treatment of individual fibers of said fibrous web is carried out; the improvement which comprises employing a fibrous web weighing from 15 to 100 g/m$^2$ as said fibrous web, guiding said fibrous web onto a first supporting member consisting of a smooth-surfaced water impermeable endless belt, carrying out a preliminary entangling treatment with the water jet streams ejected from said nozzles arranged with respect to said first supporting member, guiding said fibrous web entangled to a certain degree through said preliminary entangling treatment onto each of second supporting members consisting of a plurality of smooth-surfaced water impermeable rolls disposed with intervals, and carrying out said entangling treatment with the water jet streams ejected from said nozzles each arranged with respect to each of said second supporting members.

According to the present invention, treatment of the fibrous web is carried out with a ejection of the water jet streams on the second supporting member consisting of a plurality of water impermeable rolls multistagedly and parallely arranged in order to provide effective draining treatment and to obtain nonwoven fabrics with superior property. It is to be noted, however, that originally the fibrous web is formed with a slight entanglement of fibers and the configuration thereof which is maintained only with such mere entanglement may be liable to distortion or breakage even with minor external force. Accordingly, it may happen that when the fibrous web is guided onto the initial water impermeable roll for treatment, it is damaged by the water jet streams drained in front and in the rear of the roll and the treatment thereof becomes impossible. For this reason, preliminary entangling treatment is arranged to be carried out on the first supporting member consisting of a water impermeable belt which is capable of supporting the fibrous web with good stability, whereby necessary strength to transfer toward the said roll is provided.

In the entangling treatment of the fibers with ejection of the water jet streams on said belt and on each of said rolls which are to function as a water impermeable supporting member for the fibrous web, it happens that, where draining treatment is insufficient, the fibers floating in the water are acted upon by the water jet streams whereby energy of the water jet streams is sharply diminished, entangling treatment of the fibers are hindered, the fibrous web is caused to be disarranged and the stability in the treatment thereof is lost, as discussed previously. For this reason, in a preferred embodiment, an arrangement is made so that an average quantity of supply of water in a direction of width to be ejected onto each water impermeable supporting member is less than 400 cc/sec.cm, more preferably less than 30 cc/sec.cm. An average quantity of supply of water in a direction of width, referred to above, indicates the value obtained through F/w where F corresponds to a total flow quantity ejected into a single water impermeable supporting member and W corresponds to the effective width of nozzles on said supporting member. Where such value is more than 40 cc/sec.cm, it is not possible to obviate the disadvantageous situation or result mentioned above.

In a preferred embodiment, jet pressure of the water jet streams is less than 35 kg/cm$^2$, more preferably 15 to 30 kg/cm$^2$ and where such pressure is more than 35 kg/cm$^2$, movement of individual fibers within the fibrous web becomes great and thereby the fibrous web is caused to be in disorder and to be uneven in the fiber entanglement whilst where the pressure is less than 7 kg/cm$^2$, no effective production of nonwoven fabrics with superior property is possible, howsoever a long time treatment is carried out with respect to the fibrous web or the nozzles are brought close to the fibrous web to the extent that they nearly get in touch with the fibrous web.

The water jet streams are ejected from the nozzles. Types of the nozzles to be employed for this purpose are: for example, a nozzle of the type wherein plural jet holes are formed in a pipe at regular intervals, a nozzle of the type wherein jet holes are formed in a basic plate at regular intervals and the basic plate with such construction is incorporated into, for instance, a distributing pipe, or the like. In a preferred embodiment, the vertical cross section configuration of the jet holes of the nozzle consists of a portion with a gradually reduced diameter toward the jet holes and a portion with a small diameter extending straightforwardly in order that the resistance of water streams relative to the jet holes is lessened and the loss of pressure toward the jet holes is diminished, wherein where the length of the latter portion is supposed to be L and the diameter thereof is supposed to be D, the ratio L/D is set to be less than 4/1 or preferably less than 3/1. In case where the former portion is not of the configuration mentioned above and the ratio L/D is set to be more than 4/1, straightforward transferability of the water streams from the jet holes is equal to the case wherein said ratio L/D is set to be less than 4/1. Since, however, the resistance of water streams increases, the loss of pressure toward the jet holes becomes large. Further, the configuration of the water jet streams represents columnar streams of water the diameter of the jet holes is arranged to be 0.05 to 0.2 mm and the nozzles comprise the jet holes with intervals from 0.5 to 10 mm.

It is necessary that the belt and the individual rolls referred to above as the water impermeable supporting member for fibrous webs should be of hard surfaces sufficient enough to prevent that energy of the water jet streams is adsorbed by the deformation of the supporting members and thereby the efficiency in the fiber entanglement is lowered. In a preferred embodiment, the hardness of surface is set to be more than 50°, more preferably over 70°, according to the regulation of K6301Hs under JIS(Japanese Industrial Standard). As far as such hardness is maintained, metal, rubber, plastic and the like may be used solely or in combination to provide a multiple construction.

As the fibrous web, any one of the conventional fibers used generally in the past for the production of woven fabrics, nonwoven fabrics or the like may be used. As the web configuration, any type of random, parallel, cross web or the like may be employed. However, since the present invention is directed to a method employing a water impermeable supporting member, a fibrous web of the type with weight of 15 to 100 g/m$^2$, preferably 20 to 60 g/m$^2$ is used, such that energy of the water jet streams may efficiently be provided for the fibrous web. Where such weight is less than 15 g/m$^2$, irregularity of the fibrous web occurs and nonwoven fabrics with substantial uniformity can not be obtained. Where such weight is more than 100 g/m$^2$, sufficient effect to be enjoyed by the use of the water impermeable supporting member can not be obtained. In a preferred embodiment, a random web formed by a card provided with at least one condensing roll which is arranged between a doffer and a comber in such a manner that the circumferential surface speed is substantially lower than that of the doffer, is used as the fibrous web. With the employment of this random web, it is possible to provide a nonwoven fabric which has no difference in its lengthwise or crosswise tenacity, the fibers of which are oriented in three dimensional direction and which is richer in its bulkiness than the web obtainable from a conventional random card.

According to the method of the present invention, draining treatment can be sufficiently carried out. Since various problems involved in the method of using the water impermeable supporting member as explained above can all be resolved, efficient treatment of the fibrous web with water jet streams can be made and hence desired objects may be attained. The nonwoven fabrics obtained through the method according to the present invention do not substantially comprise openings and the fibers are intricately and firmly entangled in three dimensional direction. Accordingly, the nonwoven fabrics provided by the present invention are superior in tensile strength bulkiness and flexibility. This means that the nonwoven fabrics provided by the present invention are of excellent suitability as a constitutional element of sanitary goods, particularly such as sanitary napkins, disposable diapers or the like which are used in contact with the human body and humors. It is also possible to employ the nonwoven fabrics by the present invention for a wide variety of fields of general goods covering such as industrial filter, a wiper, a pillow case or the like.

BRIEF DESCRIPTION OF THE DRAWINGS

This invention can be more thoroughly understood by the following discussion, with reference to the drawings, wherein.

DESCRIPTION OF THE PREFERRED EMBODIMENTS

Figure 1:
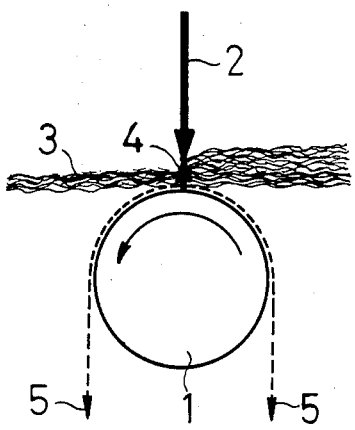
FIG. 1 shows a side elevation to illustrate the state wherein fibers are subjected to a water jet stream on a roll which is employed as a water impermeable supporting member used in the method according to the present invention.

Referring to FIG. 1, reference numeral 1 designates a typical smooth-surfaced roll employed as a water impermeable supporting member, wherein a fibrous web 3 is acted upon by water jet streams 2 against the the roll 1. The water jet streams 2 first passes through the fibrous web 3 and then rebound from the surface of the roll 1, as indicated by an arrow 4, acting again on the fibers to provide entanglement thereof. Accordingly, the fibrous web 3 is treated by an interaction between water jet streams and rebound streams. As a consequence, individual fibers of the fibrous web 3 are caused to move in three-dimensional direction whereby intricate and rigid entanglement may effectively be carried out. Water streams, their energy having them lost through the fiber entanglement, are drained partly from the circumferential surface of the roll 1 as indicated by arrows 5 and partly along the moving fibrous web. Although the treatment of the fibrous web on a smooth-surfaced endless belt employed as another water impermeable supporting member is not shown in the drawings, it is to be understood that the fibrous web is acted upon by the water jet streams in exactly the same manner as in the case of the roll 1. Water streams, which have lost their energy on the belt, are drained partly from the circumferential edges of the belt and partly along the moving fibrous web.

Figure 2:
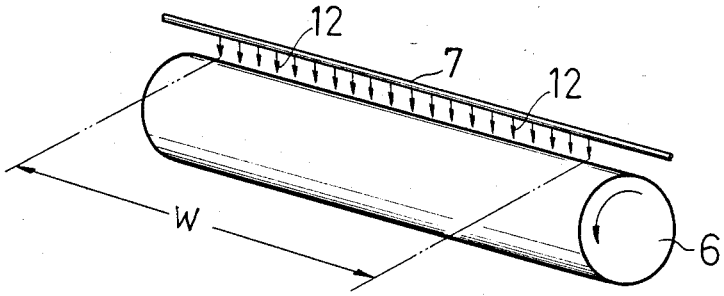
FIG. 2 is a perspective view to show how a nozzle is arranged on a roll which is employed as a water impermeable supporting member used in the method according to the present invention.
Figure 3:
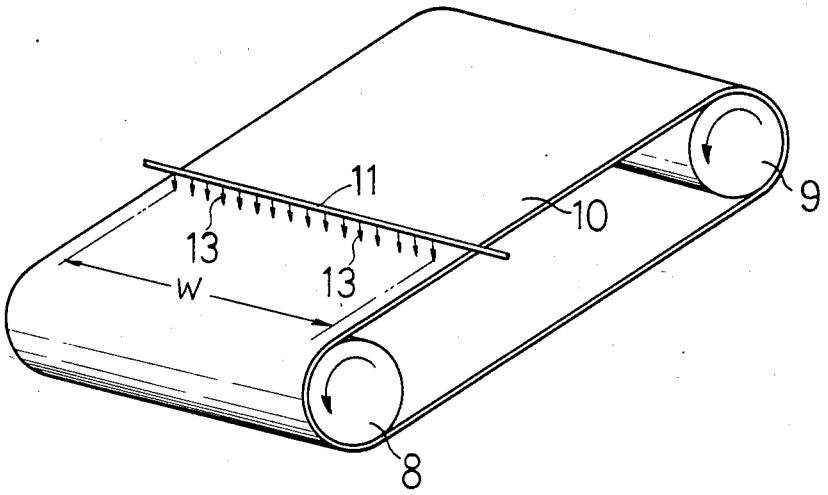
FIGS. 3 and 4 perspective views to show how a nozzle is arranged on an endless belt which is employed as another water impermeable supporting member used in the method according to the present invention.
Figure 4:
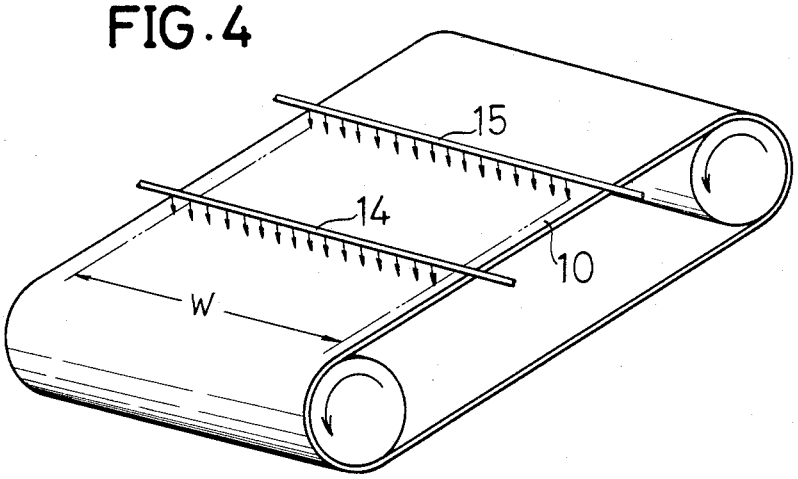

FIG. 2 shows the situation wherein a nozzle 7 is arranged on a roll 6 employed as the water impermeable supporting member. FIG. 3 shows the situation wherein a nozzle 11 is arranged over a smooth-surfaced endless belt 10 employed as another water impermeable supporting member and which is suspended between rolls 8 and 9. The roll 6 and the belt 10 consist solely of metal, rubber or plastic or of a multiple construction containing these materials in a combined state, the surface hardness thereof being more than 50°, preferably over 70°, according to the regulations of K6301Hs under JIS(-Japanese Industrial Standard). The diameter of the roll 6 is 50 to 300 mm. The nozzles 7, 11 are of the construction wherein jet holes, each being of a diameter 0.05 to 0.2 mm, are provided at regular intervals along the center of the lower surface. Such construction of the nozzles may alternatively be that wherein jet holes are formed in a basic plate at regular intervals and the basic plate with such a structure is incorporated into a distributing pipe or the like. Water jet streams 12, 13 ejected from the nozzles 7, 11 represent columnar streams and are arranged to be ejected perpendicularly with respect to the roll 6 and the belt 10. Jet holes of the nozzles 7, 11 consist of a portion with a gradually reduced diameter 48 toward ejection openings and a portion with a small diameter extending straightforwardly 49, as will be seen from FIGS. 8 (*a*), (*b*) and (*c*) covering vertical cross sections of the jet holes, the ratio L/D between the length L and the diameter D of the portion 49 being set to be less than 4/1, preferably less than 3/1. Due to such configuration of the jet holes of the nozzle and the ratio L/D which is set to be less than 4/1, the resistance of water streams relative to the jet holes is lessened and the loss of pressure toward the jet holes is diminished. Supposing that the vertical cross section of the jet holes represents a cylindrical configuration being of same diameter and the said ratio L/D is set to be more than 4/1, straightforward transferability of water streams from the jet holes is equal to the case wherein said ratio L/D is set to be less than 4/1, whilst resistance of water streams increases and the loss of pressure toward the jet holes becomes large. Where the straightforward transferability of the water streams is bad, entangling treatment of the fibers of the fibrous web cannot effectively be carried out and where said loss of pressure is large, considerable economic disadvantage results. The average quantity of supply of water jet streams in a direction of width to be ejected onto each of the roll 6 and the belt 10 is less than 40 cc/sec.cm, preferably less than 30 cc/sec.cm and where a row of the nozzles 7, 11 is disposed on the roll 6 and the belt 10, as shown in FIGS. 2 and 3, said average quantity of supply of liquid jet streams is determined by: said quantity of supply (cc/sec.cm)=F (quantity of flow from the nozzle 7 or 11)/W(effective width of the nozzle 7 or 11). Where two rows of the nozzles 14, 15 are disposed on the belt 10, as shown in FIG. 4, determination is made on the basis of: said average quantity of supply in a direction of width (cc/sec.cm)=$F_1$ (quantity of flow from the nozzle 14)+$F_2$ (quantity of flow from the nozzle 15)/W(effective width of the nozzles 14, 15). Where said quantity of supply which is determined by said F/W is more than 40 cc/sec.cm, drainage of the water jet streams to be ejected onto the roll 6 and the belt 10 becomes insufficient, whereby the energy of the water jet streams is sharply diminished, the efficiency in the fiber entanglement is affected, the fibrous web is caused to be in disorder and, hence, the stability in treatment is damaged.

Figure 5:
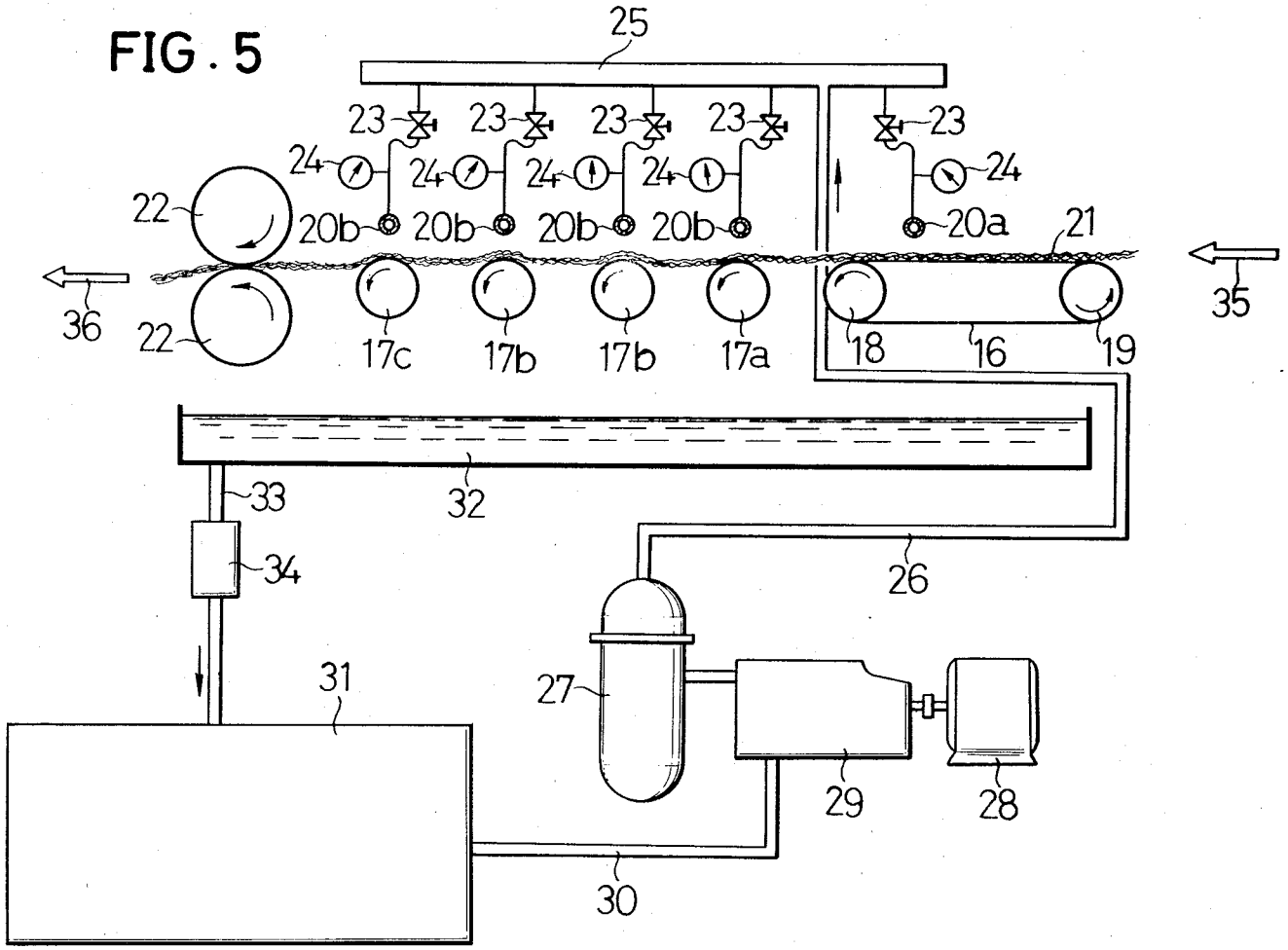
FIG. 5 is a schematic side elevation showing one example of an apparatus to carry out the method according to the present invention.

FIG. 5 shows one embodiment of an apparatus in order to exercise the method according to the present invention. In this apparatus, the endless belt and the roll which are employed as the water impermeable supporting member shown in FIGS. 2 and 3 are incorporated, wherein numeral 16 is the belt and indicated by reference numerals 17a, 17b and 17c are the rolls. The belt 16 is suspended between the rolls 18 and 19. The rolls 17a, 17b 17c appear in the upper left portion of the drawings, relative to the belt 16. Further, the nozzles of the type as shown in FIGS. 2 and 3 are incorporated in the apparatus. These nozzles are designated by reference numerals 20a, 20b and are disposed above the belt 16, the rolls 17a, 17b and 17c. Designated by a reference numeral 22 and shown in the upper left portion of the roll 17c is a pair of squeezing rollers to squeeze moisture of the fibrous web 21. Each of the nozzles 20a, 20b is connected to a distribution tank 25 via a pressure regulating valve 23 and a pressure gauge 24. The distribution tank 25 is connected to a filter tank 27 via a pipe 26. The filter tank 27 is connected to a pressure pump 29 designed to be driven by a motor 28. The pressure pump 29 is connected to a tank 31 via a pipe 30. Meanwhile a dish-like recovery tank 32 is disposed in the lower surface area of the belt 16, the rolls 17a, 17b, 17c and the squeezing rollers 22. The recovery tank 32 is connected to a tank 31 via a pipe 33 and a filter box 34.

According to such apparatus as explained above, water contained in the tank 31 is subjected to pressure by the high pressure pump 29, filtered by the filter tank 27, conveyed to the distribution tank 25 and then distributed to each of the nozzles 20a, 20b whereby water streams with ejection pressure of from 7 to 35 kg/cm$^2$ and with an average quantity of supply in a direction of width less than 40 cc/sec.cm are ejected from each of the nozzles 20a, 20b onto the belt 16 and onto each of the rolls 17a, 17b, 17c. Accordingly, while the fibrous web 21 with weight of 15 to 110 g/m$^2$ is guided from the direction indicated by an arrow 35 onto the belt 16 and toward the direction indicated by an arrow 36 passes over the intervals between the belt 16 and the adjacent rolls 17a, 17b, 17c, preliminary entangling treatment is given to the fibrous web on the belt 16 by high pressure water streams ejected from the nozzle 20a, power of such preliminary entangling treatment being in a degree that the fibrous web 21 may not be subjected to distortion or damage by the drainage of the high pressure streams of water ejected from each of the nozzles 20a, 20b. The fibrous web 21 treated to a certain degree through such preliminary entangling treatment is then guided onto each of the rolls 17a, 17b, 17c so as to be subjected to a gradual and regular entangling treatment by the high pressure water streams ejected from each of the nozzles 20b, whereafter the fibrous web 21 is conveyed to the rollers 22 to squeeze almost all the moisture out before being further transferred to a drying process (not shown). The drainage from the belt 16 and from each of the rolls 17a, 17b, 17c and the squeezing rollers 22 is arranged to fall into the recovery tank 32 so as to be recovered thereby, subjected to filtration by the filter box 34 before being further conveyed to the tank 31.

Figure 6:
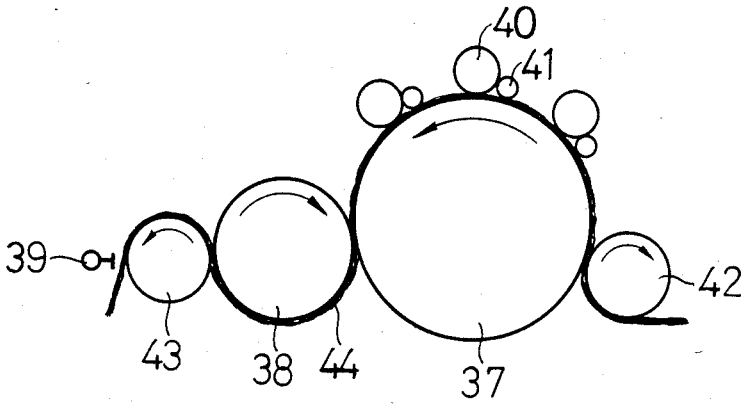
FIG. 6 is a schematic side elevation of a card forming a fibrous web used in the method according to the present invention.

FIG. 6 shows a preferred card to form a preferred fibrous web to be employed in the method according to the present invention. This card comprises an arrangement wherein in a mechanism of an ordinary card having a cylinder 37, a doffer 38, a comber 39, a worker 40, a stripper 41 and a taker-in roller 42; a condensing roll 43 having substantially the same circumferential surface structure as that of the doffer 38 is disposed between the doffer 38 and the comber 39, circumferential surface speed of the condensing roll 43 being designed to be substantially lower than that of the doffer 38. With the employment of such card, it is possible to arrange that the fibrous web 44 is contracted in its direction of flow by a cooperative action between the doffer 38 and the condensing roll 43 and the fiber thereof is accumulated. Accordingly, the fibrous web formed with this card represents a randomized configuration, it being extremely rich in its bulkiness and not having so much lengthwise and crosswise vectorial difference. Although FIG. 6 illustrates an arrangement wherein one condensing roll 43 is provided, it is possible to arrange that two condensing rolls are disposed in opposite direction. Such arrangement of providing two condensing rolls is found to be preferable for obtaining good results in condensing treatment.

Figure 7:
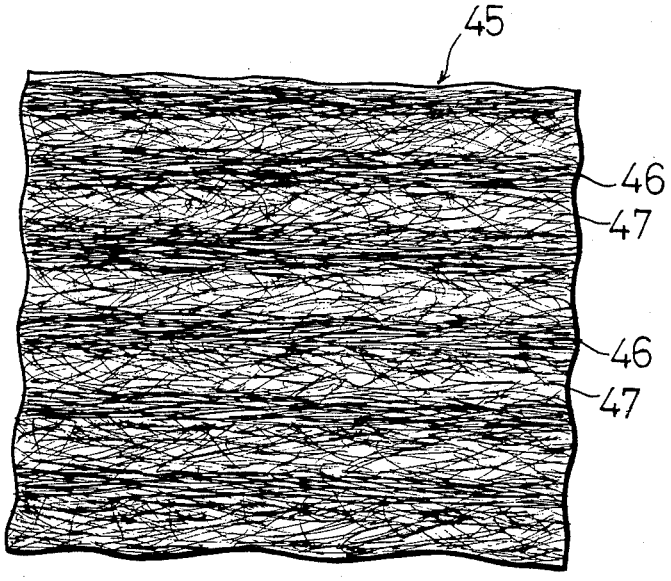
FIG. 7 is a schematic enlarged plan view of the nonwoven fabrics obtained by the method according to the present invention.
Figure 8A:
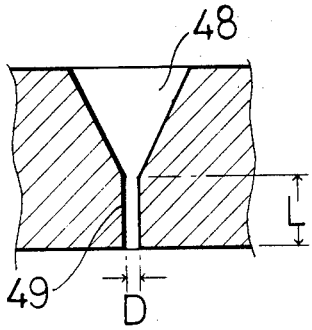
FIGS. 8(*a*)-(*d*) show vertical cross-sectional views of some examples of nozzle jet holes which are used in the method according to the present invention.
Figure 8B:
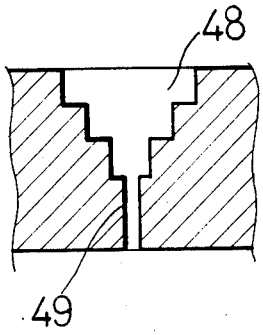
Figure 8C:
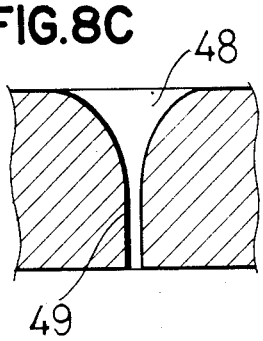
Figure 8D:
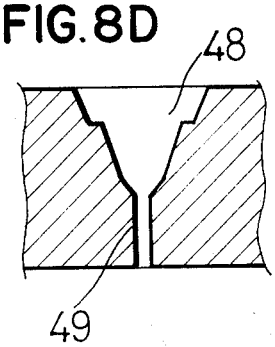

FIG. 7 shows a schematic enlarged plan view of the nonwoven fabric obtained by the method according to the present invention. This nonwoven fabric designated by a reference numeral 45 comprises a longitudinal stripe pattern in which a stripe portion 46 with high density and a stripe portion 47 with low density are arranged reciprocally in the direction of width. Entangling state of fibers of the nonwoven fabric 45 is that the stripe portions 46, 47 are reciprocally bent, twisted and entangled in the three-dimensional direction with intricacy and ridigness wherein the stripe portion 46 represents a tuft-like and a rib-like configuration having loose ties and the stripe portion 47 represents a groove-like and a valley-like configuration. Width of the stripe portions 46, 47 and the intervals therebetween may optionally be changed by the dimensions of the jet holes for the water jet streams and by the arrangement of intervals of such jet holes. The stripe portions 46, 47 will appear more distinctively where a parallel web is used as the material for the nonwoven fabric 45 while where a random web is used, no such clear appearance of the stripe portions is available. In case where it is required that superior tension of the nonwoven fabric is provided, use of a random web, particularly use of the random web of the type formed through the card shown in FIG. 6 is advisable. The nonwoven fabric obtained in this way is rich in its bulkiness and is superior in its elasticity.

Figure 9A:
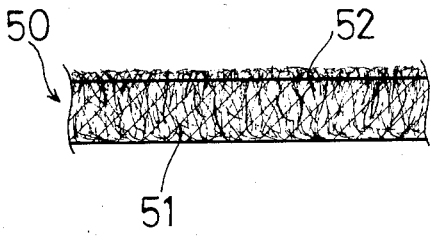
FIGS. 9 (*a*) and (*b*) show enlarged schematic cross-sectional views cut in thick direction of sheet-like products consisting of foamed sheets with soft elasticity in the surface and the inside of which fibers are planted.
Figure 9B:
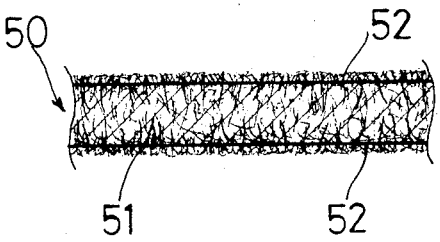

FIGS. 9 (*a*), (*b*) show a sheet-like product wherein fibers 52 are planted in a foamed sheet having soft elasticity 51. Such product 50 may be produced by the apparatus shown in FIG. 5. In this case, the soft elastic foamed sheet 51 is disposed under the lower surface of the said fibrous web 52 and the high speed streams of water are ejected thereon in a manner already explained. However, since the foamed sheet 51 has elasticity to absorb energy of the water jet streams, it is preferable to arrange that the thickness of the sheet 51 is less than 5 mm and the ejection pressure of the water jet streams is more than 35 kg/m$^2$. The sheet-like product 50 obtained in this way represents an external appearance like a flocked sheet wherein the fibrous web 52 is entangled in the surface and in the inside of the foamed sheet 51.

EXAMPLE 1

This example shows that in the method according to the present invention, the water impermeable supporting member, average supply quantity of water jet streams in a direction of width on said supporting member, ejection pressure and the hardness of surface of said supporting member are extremely important. In this example, a random web with weight of about 40 g/m$^2$ consisting of a rayon staple fiber with fineness of 15 denier and with fiber length of 51 mm is guided into the apparatus of the type as shown in FIG. 5 for jet treatment and thereafter subjected to drying at a normal temperature (room temperature). Property of the sample obtained in this way is shown in Table 1. The diameter of jet hole of the nozzle in the apparatus referred to above was 0.12 mm. In order to obtain a comparative sample, said fibrous web was guided onto an endless belt which works as a water permeable supporting member and which consists of a wire gauge with wire diameter of 0.046 mm and with mesh of 20 and treatment was made by said nozzle in the same manner as mentioned above. The sample obtained in this way was found to be of openings. Additional experiment was carried out under the condition that the nozzle 20*a* shown in FIG. 5 is closed and the fibrous web is subjected to treatment in the same manner as mentioned above without preliminary treatment on the belt 16. The result was that the fibrous web was damaged by drainage in the space between the rolls 17*a* and 18 and continuous treatment of the web became impossible.

EXAMPLE 2

This example shows that the weight of the fibrous web per square meter is important in the method according to the present invention. As an apparatus for treatment by water jet streams, the apparatus of the type shown in FIG. 5 was used. Parallel web consisting of acrylic fabric with 1.2 denier fineness was guided onto a stainless roll having hardness of 100° provided under the regulations of JIS (Japanese Industrial Standard-)—K6301Hs and then subjected to jet treatment with water jet streams ejected from the nozzle having jet orifices with diameter of 0.13 mm at a jet pressure of 30 kg/cm$^2$ and with average supply quantity of liquid of 20.5 cc/sec.cm in the direction of width and, as a result, a sample as shown in FIG. 7 was obtained.

TABLE I

| No. | Supporting member material | Supporting member hardness | Jet pressure (Kg/cm$^2$) | Average supply quantity in direction of width (cc/sec · cm) | Weight (g/m$^2$) | Tensile strength (Kg/2.5 cm) | Remarks |
|---|---|---|---|---|---|---|---|
| 1 | stainless | 100 | 7 | 20.5 | 38.7 | 0.2 | |
| 2 | stainless | 100 | 20 | 3.2 | 36.2 | 1.5 | |
| 3 | stainless | 100 | 30 | 8.4 | 39.2 | 3.7 | |
| 4 | stainless | 100 | 30 | 32.1 | 38.5 | 2.1 | Web disordered due to nearly flooded state |
| 5 | stainless | 100 | 30 | 40.2 | — | — | Web destroyed due to flood state |
| 6 | stainless | 100 | 40 | 12.8 | 32.3 | 3.2 | Disorder of web appears |
| 7 | hard rubber | 72 | 30 | 8.4 | 39.3 | 2.1 | |
| 8 | soft rubber | 45 | 30 | 8.4 | 40.1 | 1.1 | |
| 9 | Comparison product | | 30 | 8.4 | 41.2 | 1.6 | |
| 10 | | | 50 | 30.5 | 38.5 | 2.2 | |

Note:
Tensile strength in direction of MD

TABLE II

| No. | Weight (g/m$^2$) | Tensile strength (g/cm//g/m$^2$) | |
|---|---|---|---|
| 1 | 12.5 | 25.4 | Opening appears in sheet and fibers disordered |
| 2 | 30.0 | 52.1 | |
| 3 | 50.0 | 52.8 | |
| 4 | 80.0 | 40.1 | |

TABLE II-continued

| No. | Weight (g/m$^2$) | Tensile strength (g/cm//g/m$^2$) |
|---|---|---|
| 5 | 120.0 | 21.5 |

Note:
Tensile strength noted in the above Table corresponds to a value obtained in such a manner that the numerical value measured by a tension tester with regard to a tensile strength of a sample strip is divided by the weight and width of the sample.

EXAMPLE 3

This example shows that the ratio L/D between the length L of the straightforwardly extending small diameter portion 49 and the diameter D of the jet hole of the nozzle shown in FIG. 8 is important in the method according to the present invention. In this example, the nozzle of the type having the jet hole with configuration and with diameter of 130° as shown in FIG. 8(*a*) was employed and the water was ejected at a jet pressure of 30 kg/cm. The following table shows the result of measurement of flow quantity wherein nozzles each being of ratio different from the above mentioned ratio was employed.

TABLE III

| No. | D(μ) | L(μ) | L/D | Flow quantity unit (cc/min. hole) | Remarks |
|---|---|---|---|---|---|
| 1 | 130 | 0 | 0 | 59.2 | Straightforward transferability of liquid streams slightly poor |
| 2 | 130 | 200 | 1.5 | 57.8 | Straightforward transferability of liquid streams good |
| 3 | 130 | 390 | 3.0 | 52.4 | Straigtforward transferability of liquid streams good |
| 4 | 130 | 350 | 4.2 | 41.0 | Straightforward transferability of liquid streams good but flow quantity thereof unsufficient |

EXAMPLE 4

This example shows that since the random web is of small strength ratio difference in its lengthwise and crosswise tenacity, such is preferable to be employed as a treatment web to obtain a nonwoven fabric with superior property through the method according to the present invention. In this example, an apparatus of the type as shown in FIG. 5 was used; a parallel web and a random web comprised of a polyester fiber with fineness of 1.4 denier and with fiber length of 38 mm were treated and dried under the condition that a hard rubber belt and a stainless roll having hardness of 100° prescribed under the provisions of JIS (Japanese Industrial Standard)—K6301Hs are used as a water impermeable supporting member; jet pressure of the nozzle is 30 kg/cm$^2$; average supply quantity of water streams is 8.3 cc/sec.cm; and the ratio L/D between the length L of the straightforwardly extending small diameter portion of the nozzle and the width D thereof is 1.5/1. Property of the sample obtained in this manner is as appears in the following table. The parallel web explained above is the one formed by a normal card comprising no condensing roll and the random web also explained above is the one formed by the card having a condensing roll and appearing in FIG. 6.

TABLE IV

| No. | Web configuration | Weight (g/m$^2$) | Lengthwise & crosswise strength ratio | Specific volume (cm$^3$/g) |
|---|---|---|---|---|
| 1 | parallel | 35.6 | 18.1:1 | 7.2 |
| 2 | random | 35.2 | 6.2*1 | 9.3 |

(Note)
Specific volume: Observed fiber volume per 1 g

EXAMPLE 5

This example shows the manufacturing of a product of the type wherein a fiber is planted in a soft elastic foamed sheet. In this example, an apparatus of the type as shown in FIG. 5 was used. A parallel web with weight of 20 g/m$^2$ consisting of a rayon fiber with fineness of 3 denier and with fiber length of 70 mm was piled on a polyurethane foamed sheet with thickness of 1 mm and subjected to treatment. The resultant product was found to be of the structure wherein a fiber is planted and entangled in the surface and in the inside of the foamed sheet. Further, expansibility of such product was not damaged.

What is claimed is:

1. In a method of producing nonwoven fabrics wherein a fibrous web is guided onto a water impermeable supporting member and said fibrous web is subjected to water jet streams ejected from nozzles which are arranged at intervals in a manner to face the surface of said fibrous web and to run across the width thereof whereby entangling treatment of individual fibers of said fibrous web is carried out;

the improvement which comprises employing a fibrous web weighing from 15 to 100 g/m$^2$ as said fibrous web, guiding said fibrous web onto a first supporting member consisting of a smooth-surfaced water impermeable endless belt, carrying out a preliminary entangling treatment with water jet streams ejected from nozzles arranged with respect to said first supporting member, guiding said fibrous web entangled to a certain degree through said preliminary entangling treatment onto each of second supporting members consisting of a plurality of smooth-surfaced water impermeable rolls disposed at spaced intervals, and carrying out entangling treatment with water jet streams ejected from nozzles each arranged with respect to each of said second supporting members.

2. A method of producing nonwoven fabrics as claimed in claim 1, which comprises the use of water jet streams ejected from nozzles of the type having jet holes each consisting of a portion with its vertical cross section configuration being gradually reduced in its diameter toward the ejection opening and a portion with its vertical cross section configuration being extended straightforwardly in its diameter toward the ejection opening; the ratio L/D between the length L of said straightforwardly extending portion and the diameter D thereof being less than 4/1.

3. A method of producing nonwoven fabrics as claimed in claim 1, wherein the average quantity of supply of said water jet streams in the direction of the width of said first and second supporting members is less than 40 cc/sec.cm.

4. A method of producing nonwoven fabrics as claimed in claim 1, wherein the pressure of said jet streams is less than 35 kg/cm$^2$.

5. A method of producing nonwoven fabrics as claimed in claim 2, wherein the surface hardness of said first and second supporting members is at least 50° according to the provision of JIS (Japanese Industrial Standard)—K6301Hs.

6. A method of producing nonwoven fabrics as claimed in claim 1, which comprises the use of a random web as said fibrous web, said random web being formed by a card provided with at least one condensing roll which is arranged between a doffer and a comber in such a manner that the circumferential surface speed of said condensing roll is substantially lower than that of the doffer.

7. A process for producing nonwoven fabrics wherein a fibrous web is guided onto a water-impermeable supporting member and said fibrous web is subjected to a plurality of water jet streams ejected from a plurality of nozzles which are arranged at spaced apart intervals across the width of the fibrous web whereby an entangling treatment of the individual fibers of said fibrous web is carried out;

the improvement which comprises (a) starting with a fibrous web weighing from 15 to 100 g/m$^2$, (b) guiding said fibrous web into a preliminary entangling stage that comprises a first supporting member consisting of a smooth-surfaced water-impermeable endless belt, (c) carrying out a preliminary entangling treatment in said preliminary entangling stage by ejecting a plurality of water jet streams from a plurality of nozzles arranged transversely with respect to the direction of movement of said first supporting member, (d) guiding said fibrous web from said preliminary entangling stage to a final entangling stage consisting of a plurality of spaced-apart smooth-surfaced water-impermeable rolls, and (e) carrying out a final entangling treatment with water jet streams ejected from a plurality of nozzles that are located above and in parallel alignment with said spaced apart smooth-surfaced water-impermeable rolls.

8. A process for producing nonwoven fabrics as set forth in claim 7, which comprises the use of water jet streams ejected from nozzles of the type having jet holes each consisting of a portion with its vertical cross section configuration being gradually reduced in its diameter toward the ejection opening and a portion with its vertical cross section configuration being extended straightforwardly in its diameter toward the ejection opening; the ratio L/D between the length L of said straightforwardly extending portion and the diameter D thereof being less than 4/1.

9. A method of producing nonwoven fabrics as set forth in claim 7 wherein the average quantity of supply of said water jet streams in the direction of the width of said first and second supporting members is less than 40 cc/sec.cm.

10. A method of producing nonwoven fabrics as set forth in claim 7 wherein the back pressure of said jet streams is less than 35 $kg/cm^2$.

11. A method of producing nonwoven fabrics as set forth in claim 7 wherein the surface hardness of said first and second supporting members is at least 50° C. according to the provisions of JIS (Japanese Industrial Standard)—K6301Hs.

12. A method of producing nonwoven fabrics as set forth in claim 7 which comprises the use of a random web as said fibrous web, said random web being formed by a card provided with at least one condensing roll which is arranged between a doffer and a comber in such a manner that the circumferential surface speed of the condensing roll is substantially lower than that of the doffer.

* * * * *